United States Patent [19]

Cook et al.

[11] 4,203,622

[45] May 20, 1980

[54] SAFETY LATCH

[75] Inventors: Sanford L. Cook, Ocean; Justin J. Molisani, Bricktown; Kenneth I. Dennison, Jr., West Allenhurst, all of N.J.

[73] Assignee: Standard Keil Hardware Manufacturing Company, a Division of Buildex Incorporated, Allenwood, N.J.

[21] Appl. No.: 973,264

[22] Filed: Dec. 26, 1978

[51] Int. Cl.[2] ..... E05C 3/22

[52] U.S. Cl. ..... 292/221; 292/1; 292/DIG. 65; 292/DIG. 71

[58] Field of Search ..... 292/1, 86, 221, DIG. 37, 292/DIG. 65, DIG. 71

[56] References Cited

U.S. PATENT DOCUMENTS

| | | | |
|---|---|---|---|
| 718,081 | 1/1903 | Brackett | 292/DIG. 37 |
| 2,256,447 | 9/1941 | Burke | 292/223 |
| 2,893,772 | 7/1959 | Edwards | 292/123 X |
| 3,045,465 | 7/1962 | Larson | 292/223 X |
| 3,446,524 | 5/1969 | Barry | 292/223 |

*Primary Examiner*—Richard E. Moore

*Attorney, Agent, or Firm*—Blum, Kaplan, Friedman, Silberman & Beran

[57] ABSTRACT

A latch suitable for use on the door of a walk-in refrigerator can be opened from the exterior thereof and in addition from the inside of the cabinet as well as by means of an electrical signal. The latch is provided with a vapor barrier to prevent flow of water vapor along that part of the mechanism by means of which the latch is operable from the interior of the cabinet, flow of water vapor presenting the danger of frost-formation in said mechanism which could adversely affect the operation thereof. Optionally, the latch is provided with a switch which is closed on operation of the latch to activate an external device such as a vent port or an alarm signal.

15 Claims, 8 Drawing Figures

SAFETY LATCH

BACKGROUND OF THE INVENTION

The art of latches for refrigerator doors is well developed, it being common practice for such latches to be operable both in the normal way by means of an exterior handle and from the interior of the door to which the latch is affixed. In general, such latches can be released from the interior of the cabinet even when the latch is locked so far as operability by the exterior handle is concerned. In fact, such latches are generally provided with a tumbler or cam lock and an opening through which the hasp of a padlock can be inserted. As is obvious, a safety release is necessary to provide for escape of a workman from the interior of the cabinet should the latch be locked, either inadvertently or maliciously with an individual inside the cabinet.

Although a wide variety of mechanisms for such latches have been devised, there are still difficulties to overcome. One of these stems from the fact that the safety release generally includes a pushrod passing through a channel in the door. Water vapor can enter this channel and can freeze on contact with the pushrod, forming frost crystals which can interfere with the operation of the safety release. Also, since the temperature of the rod where it makes contact with the latch may also be below freezing, water vapor can freeze out at the opening in the latch housing through which the rod penetrates into the interior thereof. As is evident, these difficulties can lead to malfunction of the safety release feature. In addition, it has been found desirable to attempt to improve the latch mechanism with a view to increasing the life of the latch. Finally, conventional latches are neither operable from a distance nor can they be used to operate external mechanisms such as a vent port. Operation of a vent port in conjunction with operation of a latch mechanism is a highly desirable feature since it facilitates opening of the door. The present invention is designed to overcome the above disadvantages and provide the electrical features described.

SUMMARY OF THE INVENTION

A latch in accordance with the present invention provides a vapor barrier at the end of the safety release mechanism at the inner surface of the door to which the latch is affixed. Said vapor barrier may be in the form of a sheet of flexible plastic which can be sealed over the end of the usual pushrod to prevent access of water vapor to the space between the pushrod and the channel in the door. Also, a second vapor barrier may be provided at the surface of the door in contact with the latch to prevent access of water vapor to the latch mechanism or to the same space from the exterior of the door. Also, the second vapor barrier prevents access of water vapor to the interior of the latch where crystallization of such water vapor could interfere with the operation of the latch mechanism.

In a preferred embodiment a plastic cup is sealed around the rim thereof to the sheet of flexible plastic at the interior of the door to provide an additional vapor barrier, the cup seating within a corresponding recess in the door.

In a further embodiment of the invention a switch is closed when the handle of the latch is operated thereby providing for activation of an external device such as a vent port whenever the latch mechanism is put into action.

In yet another embodiment, a solenoid operable by an external signal is connected to the latch mechanism to operate said latch from a point distant therefrom.

In still a further embodiment of the invention, the latch mechanism includes a knee-action linkage which increases the reliability and life of said mechanism.

In all of the embodiments a single spring provides for return of the latch handle from retracted to seated position, for engaging the latch-bolt with the striker assembly on the door jamb when the handle is released and return of the safety release mechanism from activated position to standby position, i.e., seated position. A supplementary spring optionally is included for increasing the speed and reliability of the actions effected by said single spring.

Accordingly, an object of the present invention is a latch suitable for use on the door of a walk-in refrigerator cabinet in which the reliability of an inside safety release mechanism in said latch is enhanced by incorporation of at least one vapor barrier at a surface of said door to prevent entry of water vapor into said latch.

Another object of the present invention is a latch suitable for use on the door of a walk-in refrigerator cabinet in which the reliability and life of said latch are increased by reducing the number of components which thereby reduces the cost of said latch.

A further object of the present invention is a latch suitable for use on the door of a walk-in refrigerator cabinet wherein a single spring can return the handle thereof to seated position, effect engagement of the bolt thereof with the striker assembly on release of said handle, and return a safety release mechanism from active position to standby position.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
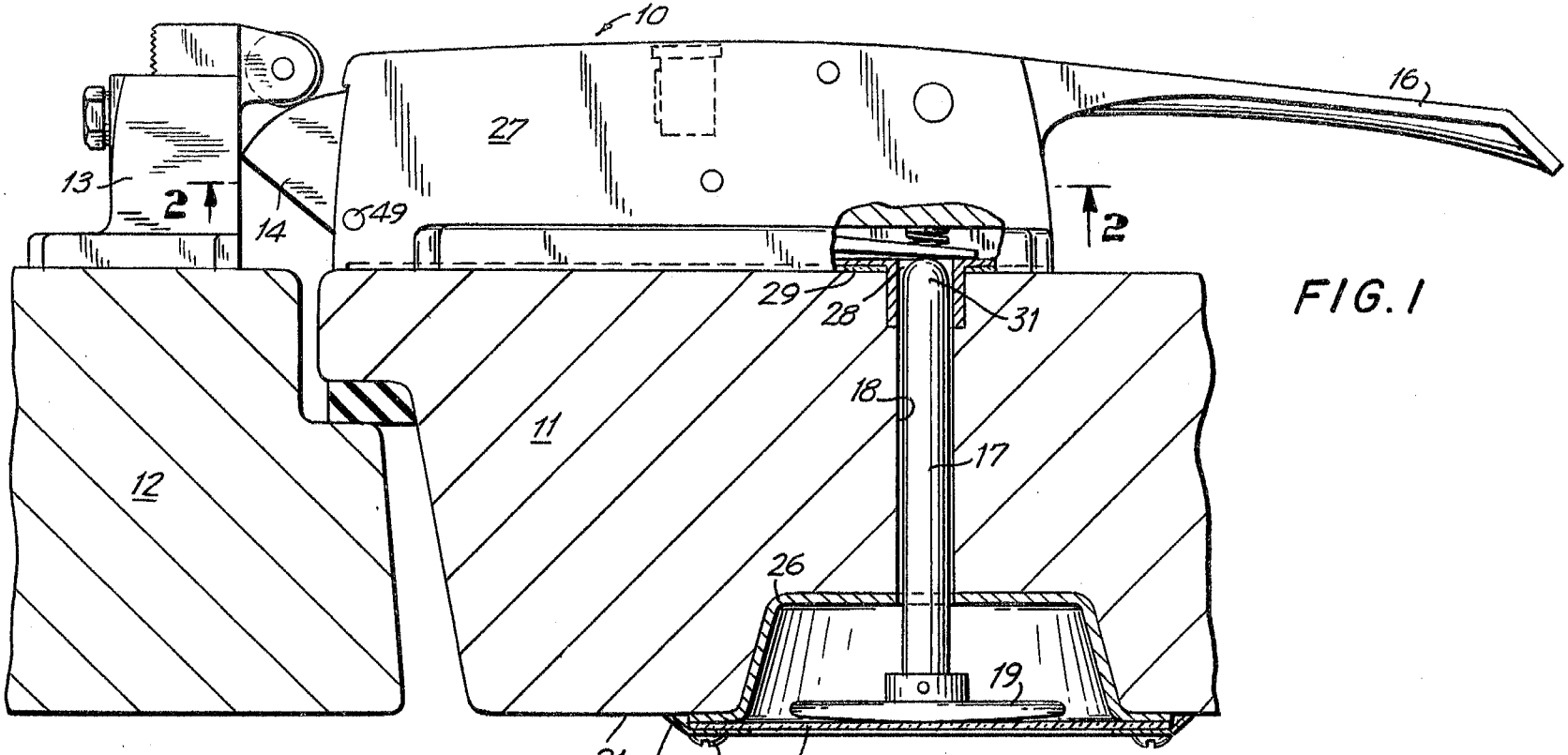
FIG. 1 is a plan view, in partial section, of a latch in accordance with the present invention affixed to a door of a walk-in refrigerator cabinet.

In the embodiment of FIG. 1 a latch in accordance with the present invention is indicated generally by the reference numeral 10, said latch being attached to a door 11 which closes against a jamb 12 to which is affixed a striker assembly 13. In the normally-closed condition of the latch, bolt 14 is positioned within striker assembly 13. Bolt 14 can be withdrawn from the striker assembly 13 by an operator on the outside of a refrigerator cabinet fitted with door 11 by raising handle 16 or by pushing on pushrod 17 from the interior of the cabinet, pushrod 17 lying within a channel 18 in the door. Pushrod 17 preferably has a plate 19 attached to the end thereof which is proximate the inner surface 21 of door 11. Pushrod 17 is part of an inner safety release mechanism which will be described in detail below.

Since the interior of the refrigerator cabinet is generally below the freezing point of water, the entry of water vapor into the channel can result in the formation of frost in the channel, such frost presenting the hazard of interference with free axial motion of the pushrod and thereby interfering with the opening of the door in the event of an emergency.

To eliminate the possibility of vapor entering channel 18, a vapor barrier 22 is sealed against the inner surface 21 of the door. A rigid trim ring 23, preferably of stainless steel, cooperates with screws 24 to hold the periphery of the flexible sheet against the door. The vapor barrier may also include a plastic cup 26 which fits within a corresponding recess in the door and constitutes a second stage vapor barrier. Moreover, it provides a housing for a recess into which plate 19 can be moved when pressure is exerted on said plate for operation of the safety release mechanism. Housing 27 of the latch has an opening 28 therein through which pushrod 17 can pass for operation of the inside safety release mechanism. To prevent water vapor from entering channel 18 and housing 27, preferably, an additional vapor barrier 29 is provided between housing 27 and the outer surface of door 11. By this means water vapor is prevented from entering channel 18 around pushrod 17 from either end of the channel. In addition, pushrod 17 may be cold enough so that it could cause condensation at end 31 thereof. Vapor barrier 29 prevents access of moisture to this region.

It is preferred that vapor barrier 22 be of clear flexible plastic so that visual inspection can determine whether any condensation has taken place therein, such condensation or frost indicating failure of one or the other of the barriers. As is evident, vapor barrier 22 need not be flush with surface 21 but can be of any convenient configuration.

Figure 2:
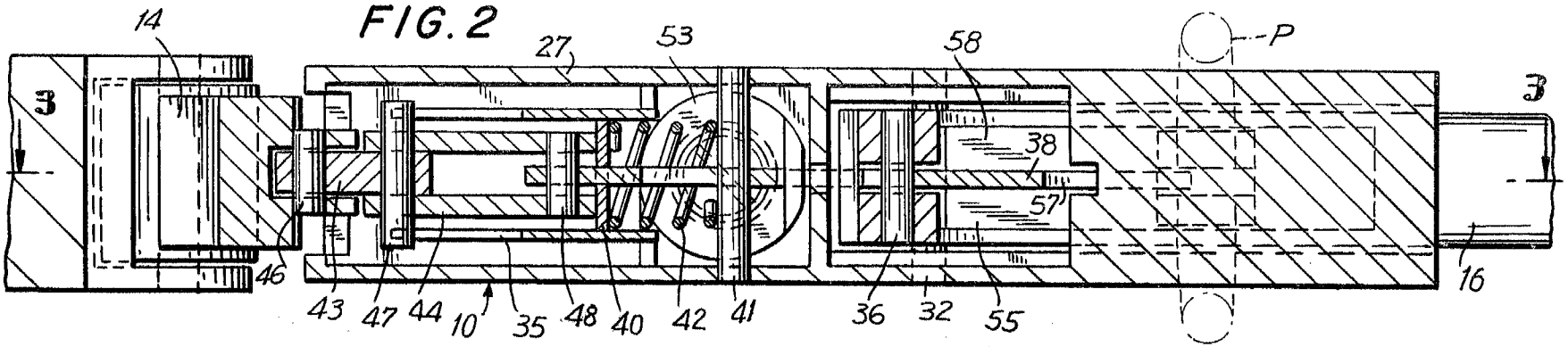
FIG. 2 is an elevational view taken along line 2—2 of FIG. 1.
Figure 3:
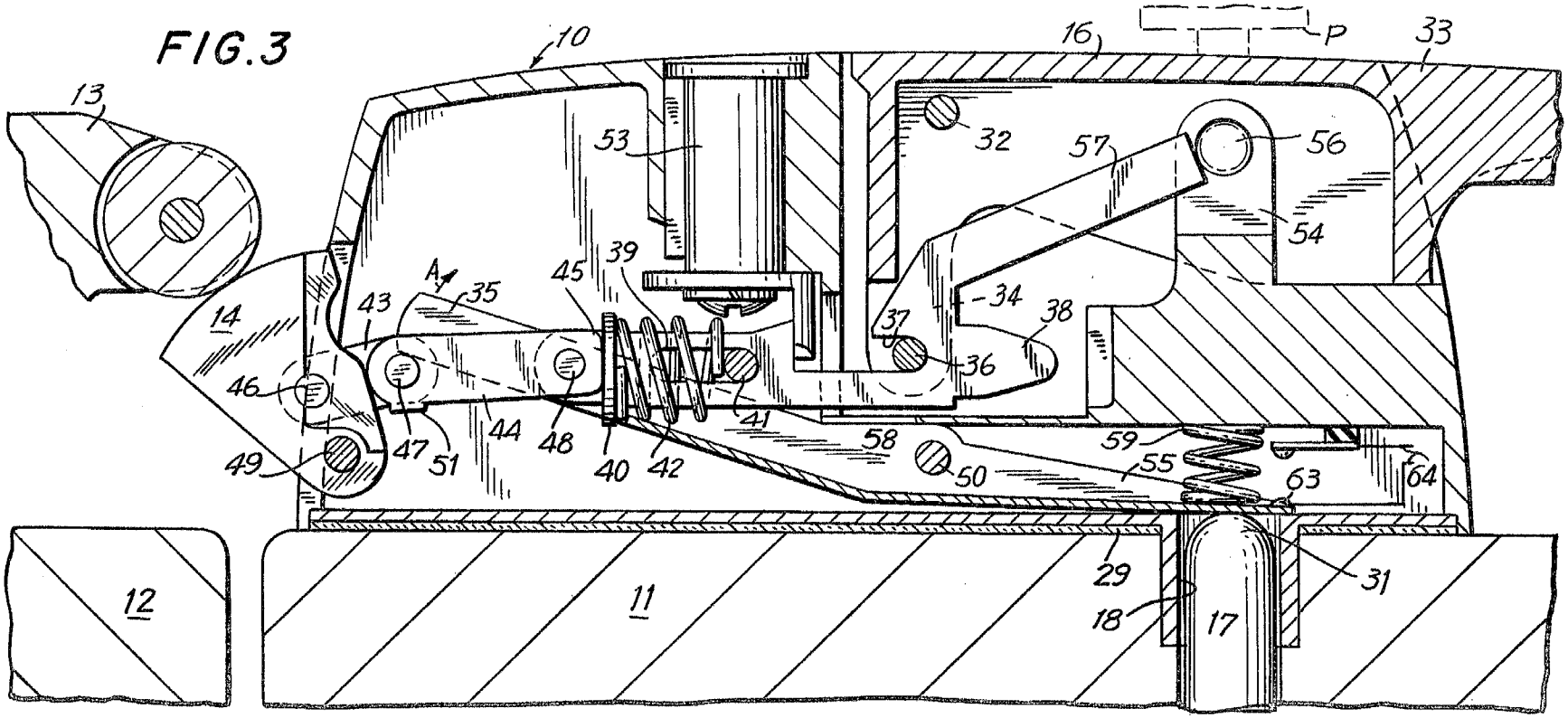
FIG. 3 is a plan view in section of the embodiment of FIG. 1.
Figure 3A:
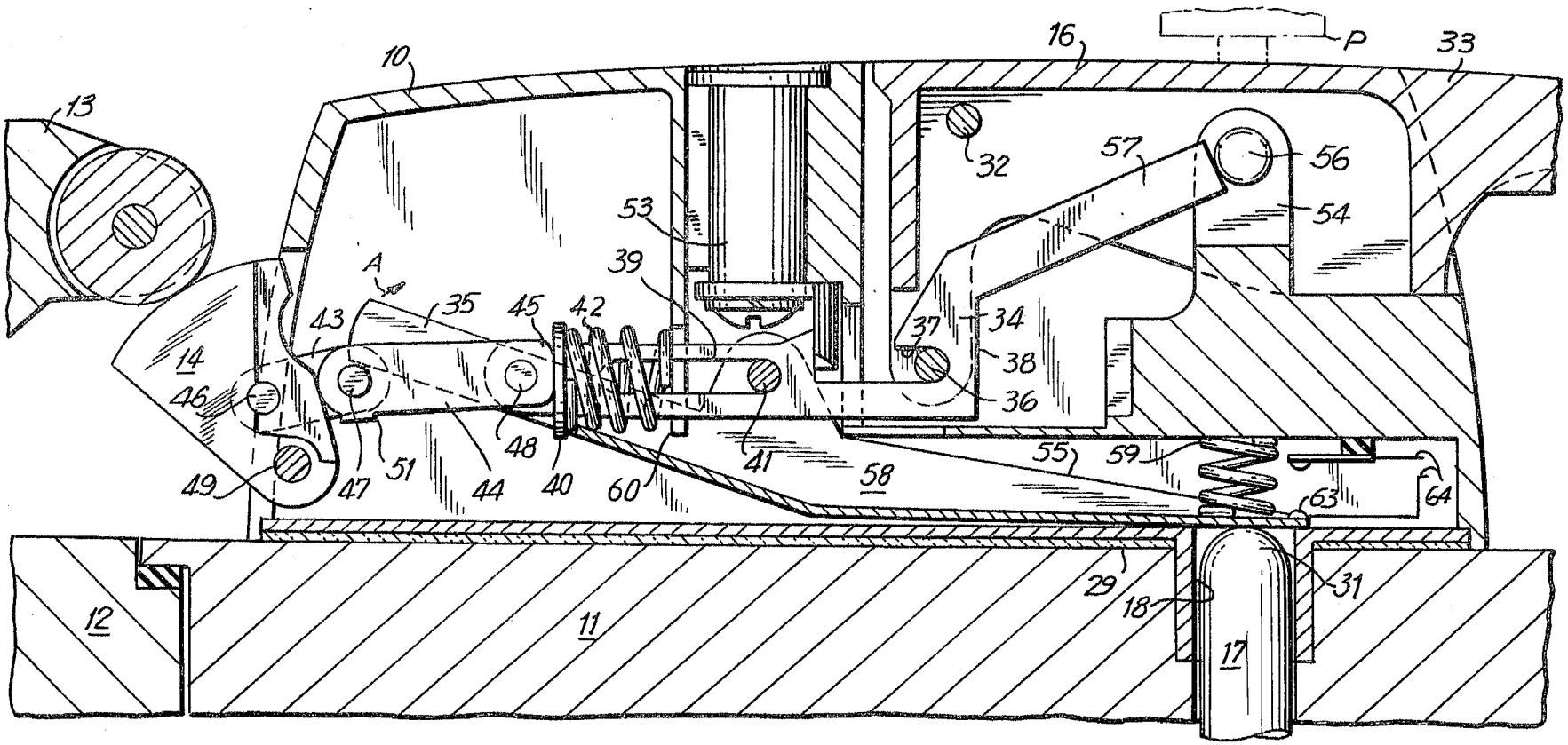
FIG. 3*a* is a plan view of another embodiment of the invention.

Referring now to FIGS. 2 and 3, the latch is shown with handle 16 in seated position and bolt 14 engaging striker assembly 13. Handle 16 pivots around pin 32 which is mounted to housing 27. Handle 16 has a long arm 33 and a short arm 34, said short arm having a pin 36 proximate the end thereof. Pin 36 fits into recess 37 in retractor bar 38. Retractor bar 38 has a slot 39 therein through which fits yoke pin 41 which, again, is mounted to housing 27. Raising handle 16 rotates said handle in counterclockwise direction, as viewed in FIG. 3, drawing retractor bar 38 to the right, the motion of retractor bar 38 being guided by yoke pin 41 in slot 39. Retractor bar 38, carrying cam follower washer 40, in moving to the right compresses compression spring 42 against yoke pin 41 and withdraws bolt 14 from the striker assembly 13 by tension exerted through retractor link 43 and cam link 44. Retractor link 43 is joined to bolt 14 by roll pin 46, cam link 44 is joined to retractor link 43 by knuckle pin 47 and to retractor bar 38 by retractor pin 48, all joins at said pins providing for rotation around said pins.

When handle 16 is released, compression spring 42 moves retractor bar 38 toward the bolt end of the latch, thereby exerting torque through pin 36 on short arm 34 of handle 16 to bring said handle to seated position. Simultaneously, retractor bar 38 thrusts cam link 44 and retractor link 43 toward the left as viewed in FIG. 3, thereby pivoting bolt 14 around bolt pivot pin 49 and inserting bolt 14 into the striker assembly. As is evident, the combination of retractor bar and links must be rigid in compression for movement of said retractor bar to the left as viewed by the Figures to engage bolt 14 with striker assembly 13. To render said combination rigid, end 45 of cam link 44 has a profile such that the pressure of washer 40 urges said link to rotate in the direction indicated by the arrow A and thereby to move knuckle pin 47 above the line joining roll pin 46 with retractor pin 48. This rotation must be limited if the combination of retractor bar and links is to be capable of thrusting bolt 14 into engagement with striker assembly 13 under the urging of spring 42. To limit rotation in the A direction, tab 51, integral with cam link 44, is so disposed as to engage the bottom surface of retractor link 43 and thereby limit the upward movement of knuckle pin 47 and the link ends attached thereto. Obviously, tab 51 could be made integral with retractor link 43 and disposed to engage the bottom of cam link 44 and thereby provide the same desired rigidity under compression.

Housing 27 holds a cylinder lock to which is attached a locking cam 53. In the position shown in FIGS. 2 and 3, said locking cam 53 interferes with movement of retractor bar 38 to the right and prevents movement of the handle into retracted position. The locking cam 53 can be rotated into retracted position. The locking cam 53 can be rotated out of the way by rotation of the cylinder lock using an appropriate key. As a further protection against unauthorized opening of the latch, housing 27 has a boss 54 with an opening 56 therein, handle 16 having a corresponding opening. The hasp of a padlock (not shown) can be passed through said openings to prevent retraction of handle 16. Also, retractor bar 38 has an extension arm 57 so disposed as to engage the hasp of said padlock when in place, interference between said hasp and extension arm preventing movement of said retractor bar to the right and thereby preventing opening of said latch from the exterior of the cabinet.

Conveniently, as shown in FIG. 2, cam and tab links 43 and 44 are provided in pairs to prevent torque about an axis perpendicular to said pins.

Figure 4:
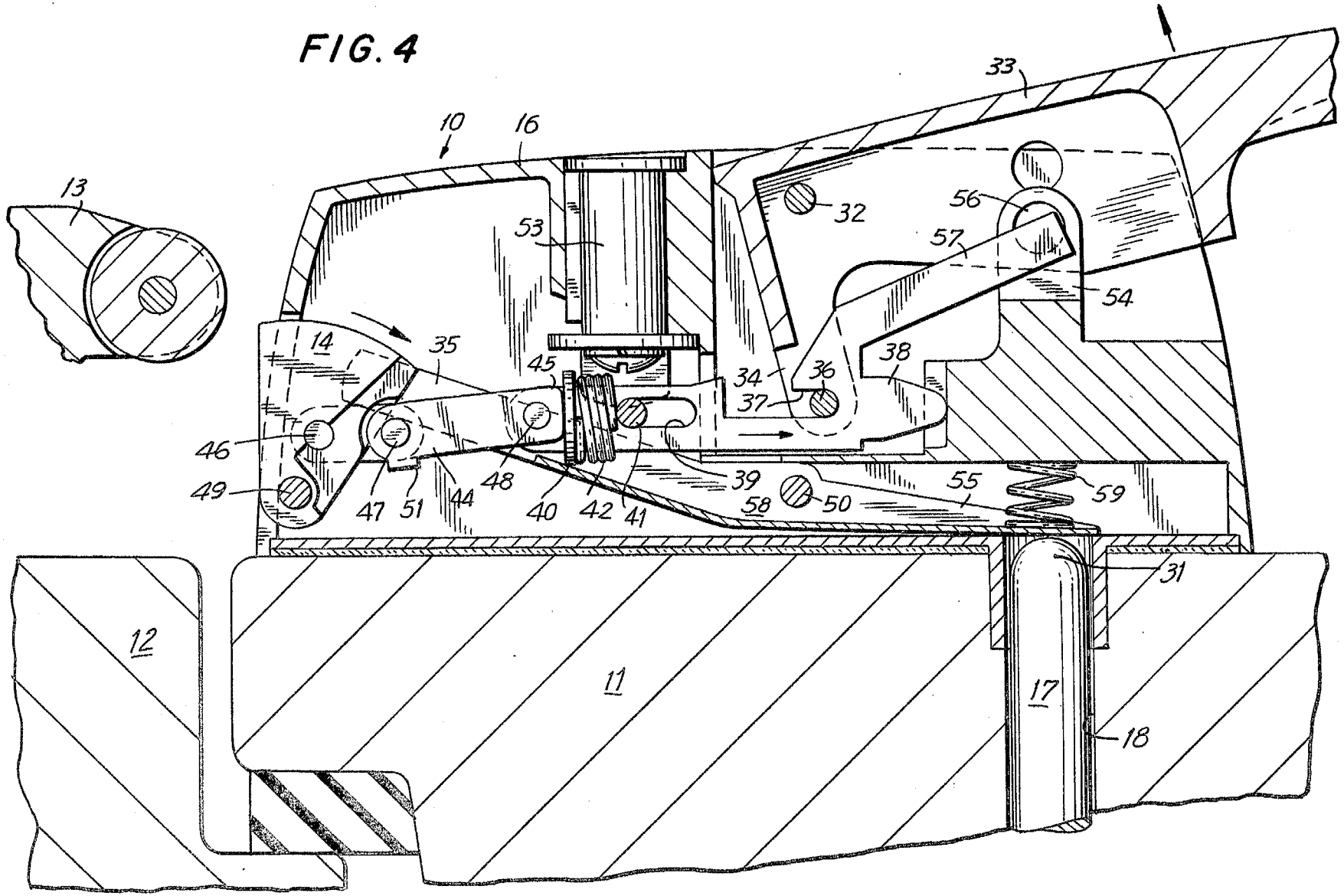
FIG. 4 is another sectional plan view of the embodiment of FIG. 1 with the handle of the latch retracted.
Figure 5:
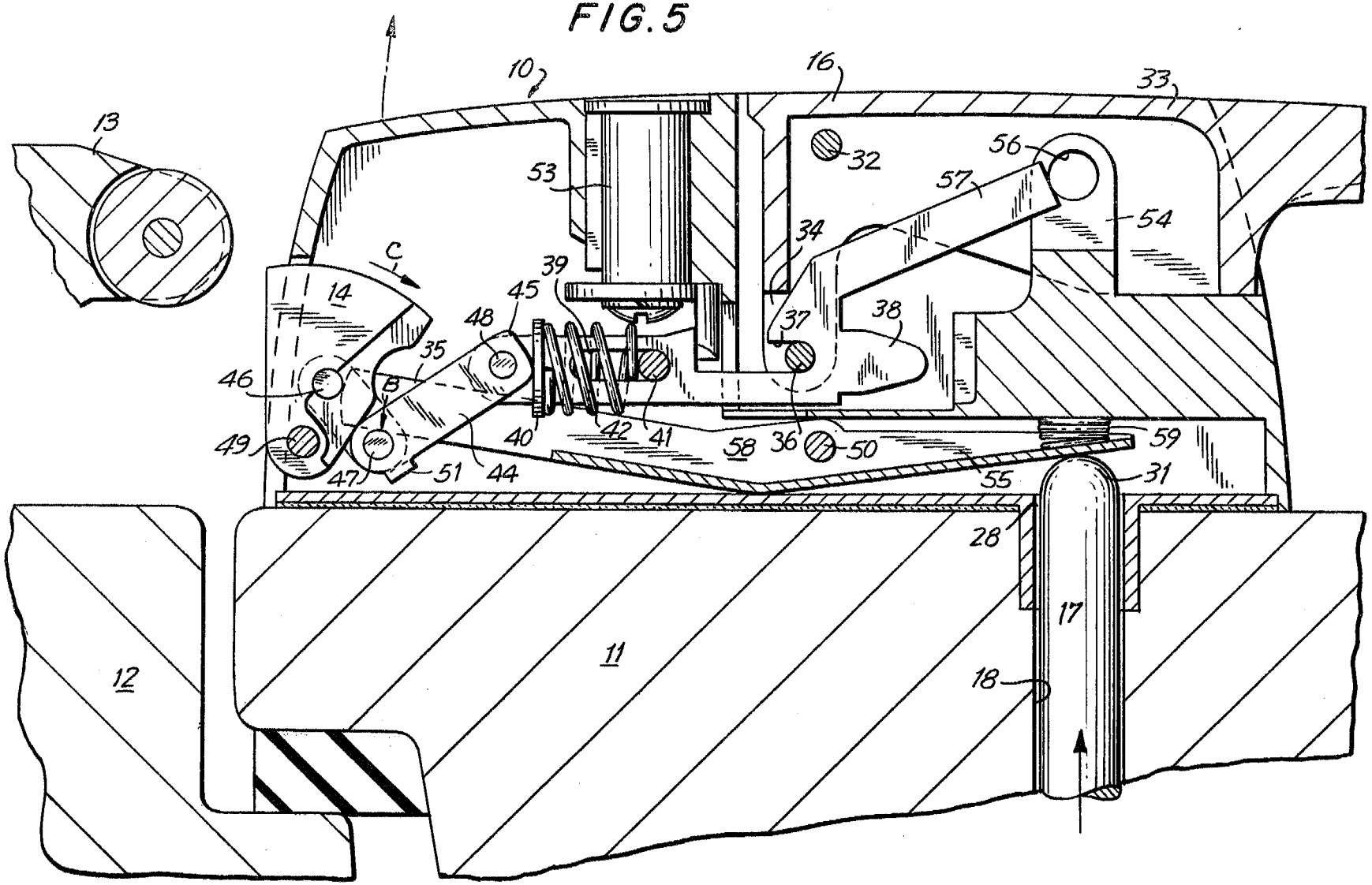
FIG. 5 is again a sectional plan view of the embodiment of FIG. 1 showing the operation of the inside safety release.

To open the door from the inside of the cabinet, as aforenoted, pushrod 17 is moved manually toward the outside of the door. An end of pushrod 17 presses against yoked arm 55 of inside release yoke 58 rotating same about a pin 50 mounted to housing 27 as shown in FIG. 2. Operating arm 35 of inside release yoke 58 then presses downwardly as viewed in said Figure, on knuckle pin 47 forcing said pin and the links attached thereto through the neutral position defined by the line through roll pin 46 and retractor pin 48. As knuckle pin 47 is forced downwardly, the knuckle action of the pair of links draws the bolt 14 out of the striker assembly so that the door can be opened. It will be noted that the inside safety release is operable regardless of the position of handle 16 and of whether the latch is locked by either or both of the cylinder lock and a padlock. After using the inside safety release, inside release yoke 58 is returned to standby position as shown in FIG. 3 by the upward thrust of knuckle pin generated by spring 42 on cam end 45 of cam link 44 through cam follower washer 40. The speed and reliability of return of the components to seated or standby position may be enhanced by incorporation of an auxiliary spring 59 disposed for urging inside release yoke 58 to standby position. The operation of the latch by means of handle 16, links 43 and 44 being placed in tension and spring 42 in compression, is shown in FIG. 4 and it can readily be seen that none of the members comprising the mechanism is subjected to severe stress so that a long useful life can be expected. Similarly, FIG. 5 shows the operation of the inside release, knuckle pin 47 being moved in the direction indicated by arrow B by engagement with operating arm 35 of inside release yoke 58 under urging by pushrod 17. The resultant shortening of the distance between roll pin 46 and retractor pin 48 causes bolt 14 to pivot around pin 49 in the direction of arrow C, disengaging the bolt from the striker assembly.

FIG. *3a* shows an embodiment similar to that of FIG. 3 except for the pivoting of inside release yoke 58 and the means of limiting the excursion of retractor bar 38 to the right, as viewed in FIG. *3a*. Thus, inside release yoke 58 is pivoted on yoke pin 41, thereby eliminating the need for pin 50, and interposition of wall 60 between spring 42 and yoke pin 41 so that said spring bears against said wall instead of said pin, also thereby eliminates the possibility of wear of said pin by contact between said spring and said pin.

Figure 6:
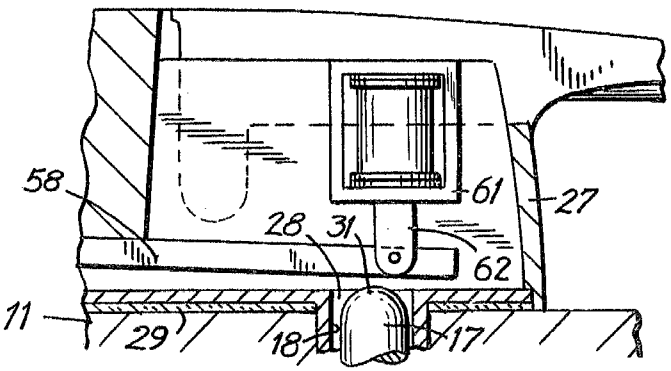
FIG. 6 is a partial view showing an embodiment incorporating a solenoid for operation of a latch from a distant point.

FIG. 6 shows a solenoid 61 mounted to housing 27 and having a core 62 attached to inside release yoke 58. Solenoid 61 can be connected to any of a variety of devices such as a foot-switch or a light beam—photoelectric cell combination or the like for automatic opening of the latch at the approach of an individual carrying material to be placed in the refrigerator cabinet so that the hands need not be used for opening the door. Also, a switch can be placed inside the cabinet for opening the door in this way. Most important, should the power fail, the latch can still be operated manually by pressure against push-rod 17.

In a further embodiment of the invention, a switch may be disposed in the housing so that operation of the latch will close the switch. As shown in FIG. 3, switch 63 is closed by upward movement of inside release yoke 58. Switch 63 is connected to external devices (FIG. 7) through wires 64 which pass through the housing. In the embodiment of FIG. 3, switch 63 is closed only by operation of the inside safety release. However, said switch could be disposed so that it is activated when bolt 14 is retracted or could be disposed so that it is activated only when handle 16 is retracted. Other arrangements will be evident to those skilled in the art. The advantage of such a switch is that it may be used for turning on lights, blowers, conveyors, and the like. A particular advantage is that it may be used for opening a solenoid-operated vent port. A considerable decrease in pressure in the cabinet is generated when a door is opened and this decrease presents a substantial resistance to opening the door. Opening vent ports of adequate size prior to the actual opening of the door greatly reduces the resistance to the operation.

In general, the fact that a number of operational steps are preferably taken in conjunction with opening and closing the door to a walk-in refrigerator and that such steps may be carried out electrically has not been sufficiently appreciated. Provision of a switch which is closed when the latch is opened makes it possible to carry out such steps as has already been indicated. Circuitry for operating various devices is shown schematically in FIG. 7, power being taken from lines 66 to step-down transformer 67. Contactors 68 and 69 represent devices such as a foot-switch or a light-beam switch for operating solenoid 61. The transformer also feeds power to limit switch 63 which can operate lights 71, a blower 72, a conveyor 73 or a vent port solenoid 74.

Figure 7:
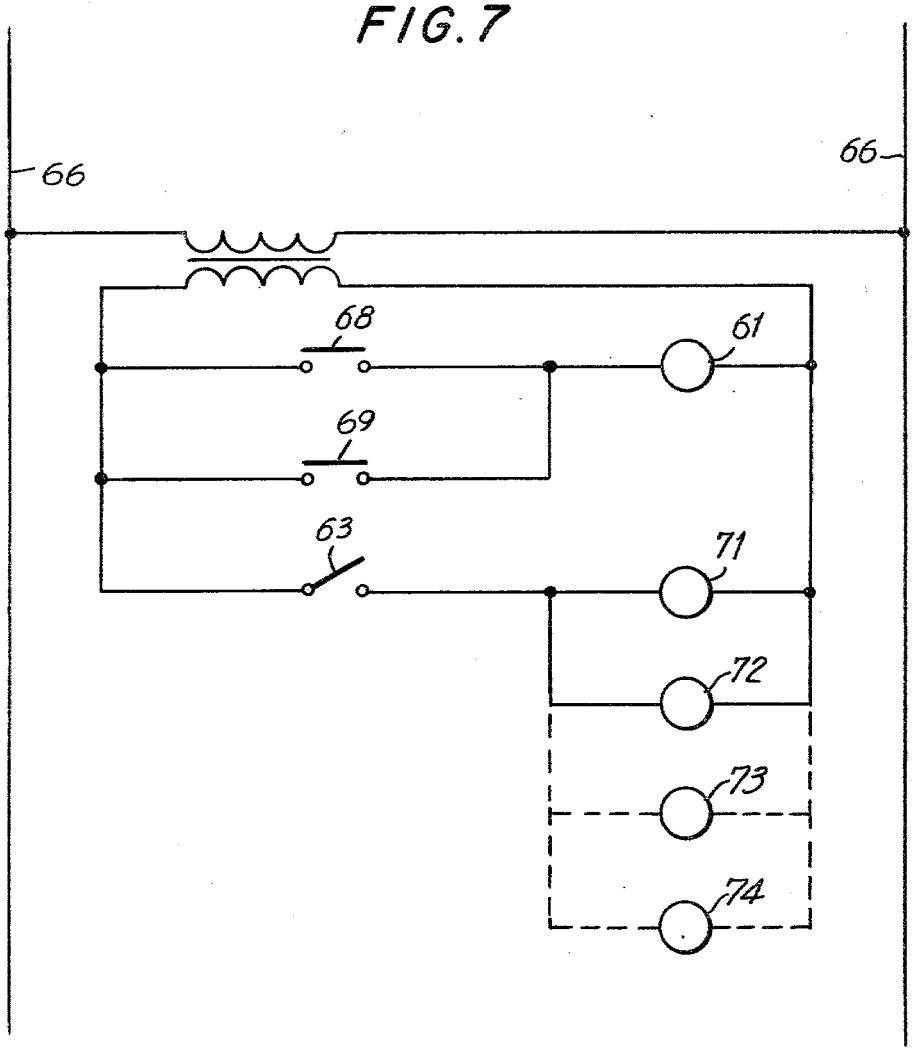
FIG. 7 is a schematic diagram of circuitry for electrical operation of said latch and for activation of auxiliary devices by opening of said latch.

The actuating system represented in FIG. 7 by contactors 68 and 69 may actually be any of a variety of prepackaged, commercially available systems such as photo-cells, card systems, pushbuttons, energy fields, heat sensors or the like.

As will be evident from the above and from the Figures, the latch as disclosed herein requires few parts and is of rugged construction and provides sufficient space within housing 27 so that a solenoid as well as a switch can readily be incorporated thereby providing for great flexibility and safety in operation of the latch itself, control of the latch and control of auxiliary devices. In addition, protection against malfunction by reason of freezing of water within the latch is provided.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved latch suitable for use on the door of a walk-in refrigerator cabinet, said latch including a latch mechanism and housing therefor, a retractable bolt in said housing for engaging a striker assembly attached to the jamb of said cabinet, a retractor handle pivotably mounted to said housing for operating said latch mechanism to retract said bolt, said handle being movable between seated position in which said bolt is extended for engaging said striker assembly and a retracted position in which said bolt is retracted from said striker assembly for opening said door, locking means mounted to said housing for selectively preventing retraction of said handle, and a pushrod for passing through a corresponding channel in said door and into an opening in said housing for activating said latch mechanism for retracting said bolt independently of whether said locking means is in locked or unlocked condition, wherein said improvement comprises a vapor barrier disposed for prevention of entry of water vapor between said pushrod and the wall of said channel cabinet and thereby for prevention of frost buildup which could interfere with the operation of said pushrod.

2. The improved latch as defined in claim 1, wherein said vapor barrier includes elements disposed at both the inner and outer surfaces of said door around said pushrod.

3. The improved latch as defined in claim 1, wherein said vapor barrier comprises a sheet of flexible plastic over said pushrod, said plastic sheet being sealingly attachable to the inner surface of said door to exclude water vapor from entering said channel while permitting operation of said pushrod by exertion of manual force through said sheet and against said pushrod.

4. The improved latch as defined in claim 3, wherein said vapor barrier further includes a cup sealingly attached to the periphery of said sheet and disposed for seating in a corresponding recess at the inner surface of said door, said cup having a centrally disposed opening for passage of said pushrod therethrough, said cup constituting an additional vapor barrier element.

5. The improvement as defined in any of claims 1, 2, 3 or 4, further comprising switch means mounted to said latch so that retraction of said bolt closes said switch means, said switch means being connectable to the exterior of said latch for operation of an auxiliary device.

6. The improvement as defined in any of claims 1, 2, 3 or 4, further comprising solenoid means operatively connected to said latch mechanism for retracting said bolt in response to an external electrical signal independently of whether said locking means is in locked or unlocked condition.

7. A latch suitable for releasably holding the door of a walk-in refrigerator cabinet to the corresponding jamb, comprising:

a housing;

a handle having a first arm exterior to said housing and a second arm interior to said housing pivotably mounted to said housing at the junction of said arms for rotation between a retracted position and a seated position corresponding to open and closed position of said latch, respectively, said handle having first pin means at the end of said second arm;

retractor bar means having an indentation for receiving said first pin means and connecting said bar means to said handle, said bar means having a longitudinal slot;

yoke pin means mounted to said housing and passing through said slot;

bolt means pivoted to said housing for releasably engaging a striker assembly affixed to said jamb and thereby holding said door to said jamb, and connected with said bar means for being moved by same into and out of engagement with said striker assembly;

spring means disposed for urging said bar means in a direction such as to move said handle into seated position and thereby to move said bolt means into engagement with said striker assembly;

retractor link and cam link connecting said bolt means with said retractor bar means for drawing said bolt means into and out of engagement with said striker assembly when said handle is rotated from and to retracted position;

cam washer means slidably mounted on said retractor bar means for transmitting force from said spring means against said cam link, said cam link having a cam end shaped for rotating said cam link in a first direction under the urging of spring means by way of said cam washer means;

second pin means pivotably joining said bolt means and said retractor link;

third pin means pivotably joining said retractor link and said cam link;

fourth pin means pivotably joining said cam link and said retractor bar;

tab member integral with one of said retractor and cam links and disposed proximate said third pin means for limiting the extent of rotation of said cam link in said first direction under the urging of said first spring means as transmitted toward said bolt means for engaging said striker assembly;

inside release yoke means for retracting said bolt means from within said cabinet independently of whether said latch is locked, said inside release yoke means being movable between a seated position and an active position and including yoke means pivotably supported on said housing and having a yoked arm and an operating arm, said housing having an opening therein providing access to said yoked arm from the exterior of said housing, said operating arm being disposed for engaging said third pin means to move said third pin means and thereby rotate said cam link in the direction opposite to said first direction for thereby drawing said second pin means toward said fourth pin for retracting said bolt means from said striker assembly, said inside release yoke means including pushrod means for passing through a channel in said door, one end of said pushrod being disposed within said opening in said housing for making contact with said yoked arm and for pushing against same, the other end of said pushrod being positionable at the inner face of said door for receiving a manual push from within said cabinet to effect retraction of said bolt means, said third pin means engaging said yoke means for returning same from active position to seated position under urging of said spring means by rotation of said cam link in said first direction, whereby a single spring means can effect the three functions of engaging said bolt means with said striker assembly and returning said handle and yoke means to seated positions.

8. The latch as defined in claim 7, further comprising solenoid means connected to said inside release yoke means for operating same in response to an external electrical signal.

9. The latch as defined in claim 7, further comprising a vapor barrier for sealing said pushrod for axial movement relative to said door while preventing flow of water vapor along the surface of said rod.

10. The latch as defined in claim 9, wherein said vapor barrier comprises a sheet of flexible plastic sealable to an interior surface of said door over the end of said pushrod.

11. The latch as defined in claim 9, wherein said vapor barrier includes a cup member having an opening therethrough for transit of said pushrod therethrough, said cup member being sealed at the rim thereof to said sheet and being arranged and constructed for fitting into a corresponding recess on said door, said cup providing for inward displacement of said sheet and providing a second barrier against transfer of water vapor.

12. The latch as defined in claims 7, 8, 9 or 10, further comprising a vapor barrier at said housing and disposed about said opening for preventing entry of water vapor into said latch through said opening and around said pushrod.

13. The latch as defined in claim 7, wherein said housing has an opening therein for receiving the hasp of a padlock, said opening being so disposed that said hasp prevents movement of said retractor bar in a direction such as to withdraw said bolt from said striker assembly.

14. The latch as defined in claim 7, further comprising supplementary spring means mounted to said latch for urging said inside release yoke means from active position to seated position.

15. The latch as defined in claim 7, wherein said inside release yoke means is pivotably mounted on said yoke pin means and thereby to said housing.

* * * * *